US011561076B2

(12) United States Patent
Jones et al.

(10) Patent No.: US 11,561,076 B2
(45) Date of Patent: Jan. 24, 2023

(54) AMMUNITION PRODUCTION LOADING MACHINE

(71) Applicant: Bitterroot Tool & Machine Inc., Stevensville, MT (US)

(72) Inventors: Randy J. Jones, Stevensville, MT (US); Jeff C. Hritcu, Stevensville, MT (US)

(73) Assignee: Bitterroot Tool & Machine, Inc., Stevensville, MT (US)

( * ) Notice: Subject to any disclaimer, the term of this patent is extended or adjusted under 35 U.S.C. 154(b) by 0 days.

(21) Appl. No.: 17/585,345

(22) Filed: Jan. 26, 2022

(65) Prior Publication Data

US 2022/0236042 A1 Jul. 28, 2022

Related U.S. Application Data

(60) Provisional application No. 63/141,619, filed on Jan. 26, 2021.

(51) Int. Cl.
*F42B 33/00* (2006.01)

(52) U.S. Cl.
CPC ..... *F42B 33/004* (2013.01); *F42B 33/005* (2013.01)

(58) Field of Classification Search
None
See application file for complete search history.

(56) References Cited

U.S. PATENT DOCUMENTS 2,341,292 A * 2/1944 Reynolds ..... B07C 5/06 209/940
2,719,453 A * 10/1955 Bahler ..... F42B 33/005 86/43

(Continued)

*Primary Examiner* — Derrick R Morgan
(74) *Attorney, Agent, or Firm* — Mitchell J. W. Vop

(57) ABSTRACT

Described is an ammunition production loading machine. The machine will load two cartridges at once and is referred to as a 'two-out" machine. The machine will be of a mechanical nature reducing the potential loss of production that occurs with pneumatic systems. Any pneumatic systems on the machine will operate only in failure instances, i.e. in the case of a powder failure the pneumatic system will obstruct the projectile feed mechanism. The machine consists of seven (7) major components, which operate in unison. The machine is intended to run a single caliber so changeover adjustments and time required to change calibers are eliminated. The machine is capable of precisely loading a complete cartridge at a rate of 240 parts per minute in a completely automated manner. The key features of this novel machine are the full automation from station to station and a cartridge retaining bullet crimp case bushing in a rotating main disk, which rotates cases from station to station. The bullet crimp case bushing has a tapered feature inside which crimps the case to the bullet. Machines in the prior art utilize slotted case inserts or features to hold the cartridge base in position for loading, which relies on a separate tool for crimping and are not fully automated. The herein described machine is fully automated and does not require a person to manually move parts from one station to the next, nor loading of individual inserts to effectuate the bullet to case connection.

12 Claims, 12 Drawing Sheets

(56) References Cited

U.S. PATENT DOCUMENTS 3,138,056 A * 6/1964 Covey ..... F42B 33/001 86/39
3,153,976 A * 10/1964 Linder ..... F42B 33/004 86/26
3,319,511 A * 5/1967 McLean ..... F42B 33/002 86/44
3,450,000 A * 6/1969 Ponsness ..... F42B 33/004 86/25
4,116,109 A * 9/1978 Ervine ..... F42B 33/004 74/820
4,127,054 A * 11/1978 Gully ..... F42B 33/0285 86/29
4,385,546 A * 5/1983 Lee ..... F42B 33/005 86/36
4,425,833 A * 1/1984 Purdie ..... F42B 33/002 86/44
4,522,102 A * 6/1985 Pickens ..... F42B 33/004 86/27
4,862,567 A * 9/1989 Beebe ..... F42B 33/005 86/43
4,869,148 A * 9/1989 Tucker ..... F42B 33/001 86/39
5,079,986 A * 1/1992 Lee ..... F42B 33/005 86/39
5,900,574 A * 5/1999 Hart ..... F42B 33/004 86/39
6,772,668 B2 * 8/2004 Shields ..... F42B 33/001 86/44
7,681,481 B1 * 3/2010 Buckley ..... F42B 33/005 86/26
7,703,369 B1 * 4/2010 Lee ..... F42B 33/10 86/43
10,935,356 B1 * 3/2021 Steven ..... F42B 33/002
2009/0013859 A1 * 1/2009 de Almeida ..... F42B 33/004 86/24
2010/0122624 A1 * 5/2010 Jackson ..... F42B 33/10 86/23
2016/0040969 A1 * 2/2016 Kleinschmit ..... F42B 33/001 86/43
2016/0084624 A1 * 3/2016 Pruett ..... F42B 33/004 86/23
2019/0368848 A1 * 12/2019 Carter ..... F42B 33/0207
2021/0278184 A1 * 9/2021 Beach ..... F42B 5/285

* cited by examiner

AMMUNITION PRODUCTION LOADING MACHINE

CROSS-REFERENCE TO RELATED APPLICATIONS

This is a U.S. Nonprovisional Application, which claims priority from U.S. Provisional Application No. 63/141,619 filed Jan. 26, 2021, the disclosure of which is hereby incorporated by reference in its entirety to provide continuity of disclosure.

STATEMENT REGARDING FEDERALLY SPONSORED RESEARCH OR DEVELOPMENT

Not Applicable

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Described is an ammunition production loading machine. The machine will load two cartridges at once and is referred to as a 'two-out" machine. The machine will be of a mechanical nature reducing the potential loss of production that occurs with pneumatic systems. Any pneumatic systems on the machine will operate only in failure instances, i.e. in the case of a powder failure the pneumatic system will obstruct the projectile feed mechanism. The machine consists of seven (7) major components, which operate in unison. The machine is intended to run a single caliber so changeover adjustments and time required to change calibers are eliminated. The machine is capable of precisely loading a complete cartridge at a rate of 240 parts per minute in a completely automated manner. This machine can be integrated into a production line which may include sealant, packaging, conveyors or additional equipment. The floor footprint of the machine is 36.00"×70.00" (including internal conveyor) to keep the unit compact and to fit into facilities where space is restricted.

BRIEF SUMMARY OF THE INVENTION

The key features of this novel machine are the full automation from station to station and a cartridge retaining bullet crimp case bushing in a rotating main disk, which rotates cases from station to station. The bullet crimp case bushing has a tapered feature inside which crimps the case to the bullet. Machines in the prior art utilize slotted case inserts or features to hold the cartridge base in position for loading, which relies on a separate tool for crimping and are not fully automated. The herein described machine is fully automated and does not require a person to manually move parts from one station to the next, nor loading of individual inserts to effectuate the bullet to case connection.

The bullet crimp case bushings float in a retainer disk assembly which allows vertical movement of the bushing within the retainer. Cases are loaded from below by a cam driven pusher that lifts the cases through a case feed disk and into the bullet crimp case bushings. As the case moves into the bushing the case imposes upward movement on the bushing within the retainer because the case is restricted by the tapered crimp feature inside the bushing. The upward movement of the bushing creates an air gap between the bottom of the bushing and the bushing retainer. The bottom of the case slides on a track below the disk to rotate to the next station.

As the main disk moves to the next station, powder is delivered and measured from the top of the disk. At the next station, bullets are inserted from the top and the pressed into position with the case supported from below.

Next, the assembled cases arrive at the crimp station, which consists of two posts driven by an upper ram. The posts press the bullet crimp case bushings, where the internal taper of the bushing compresses the case to the bullet.

The machine is generally comprised of the following stations.

1) A Case Load Station—comprised of the case collator, case feed assembly, case feed disk, and lower mechanical case pusher to insert cases into the main disk. This station also has a sensor mounted above to detect upside down or damaged cases.

2) A Powder Load Station—comprised of the powder hopper, powder slides, powder delivery tubes, powder feed disk, and a laser powder measuring check.

3) A Bullet Load Station—comprised of the bullet collators, a bullet feed assembly, bullet disk, and bullet orientation means, which are either mechanical or effectuated by a camera plus feed-back mechanism.

4) A Case Bullet Crimp Station—comprised of the upper crimp tool driven by the upper ram, bullet crimp case bushings and the main disk.

5) An Inspection Station—comprised of an OAL laser height check means and a mechanical check means driven by the upper ram.

6) A Reject Station—based on the OAL, this will remove the assembled case from the disk before the eject station in the event of perceived tolerance violation.

7) An Eject Station—comprised of u mechanical assist to remove the cartridge assembly from the main disk bullet crimp case bushing and drop onto an internal conveyor. The empty bushing is now ready to receive the next empty case for loading.

The machine utilizes four rotating disks driven by index drives to rotate individual parts and material into position tor operations performed at the various stations. The four disks are: a main disk; a case feed disk; a powder feed disk; and a bullet feed disk. The disks are timed together utilizing a cogged belt drive for accuracy and to reduce back lash at the interface of each disk pair. The three material disks (case, powder and bullet) feed material to the main disk at the correct position in the cycle. The main disk is driven by a 24-position indexer. The three material disks are driven by 8-position indexers.

The primary functions of the machine disks are the following.

1) The main disk contains the bullet crimp case bushings and moves the cartridge components in a counter-clockwise direction around the table.

2) The case feed disk is fed from a single two-out case collator. The cases are dropped into the case holes via tubes and as the disk rotates clockwise under the main disk, the cases are pushed up into the bullet crimp case bushings in the main disk. The bushings are sized to match the diameter of the cartridge caliber. The case pusher is below the case feed disk and is mechanical with motion provided by a crankshaft.

3) The powder feed disk rotates clockwise slightly above the main disk and drops the powder into empty cases. The powder disk is bronze to reduce steel to steel contact and provide better wear characteristics. There is a gravity fed powder hopper above the disk with a manual shutoff slide.

4) The bullet feed disk is fed from a single two-out collator from above via tubes. The bullets drop into receiver holes and as the bullet feed disk rotates clockwise, the bullets drop into the next available cartridge in the bullet crimp case bushings. The bullets are then seated fully with a mechanical pusher from above attached to the upper ram. The bullet crimp case bushing is also machined to provide a crimp at the top of the cartridge, the bushings are pushed down from tooling on the upper ram to crimp the bullet into the case.

When completed, the fully assembled cartridges are pushed down out of the main disk and onto an internal eject conveyor. The main drive motor that turns the four indexers also powers the upper and lower rams through a rotary crank driven by a chain and clutch. The lower ram is driven by the crank and the motion is sent to the upper ram through four vertical posts. The two rams are tied together by the four vertical posts. The upper ram tooling moves the materials on and through the four rotating disks. The upper ram uses threaded tool holders to push the bullets into position and seat them into the cartridge. The upper ram also pushes the bullet crimp case bushing down to crimp the cartridge to the bullet. There is a mechanical pusher used to assist cartridge eject at the end of the cycle. Additional options located on the upper ram include: bell mouth and debris check (located on the case feed disk), mechanical powder level check (located on the powder disk), and bullet orientation check (on the bullet feed disk) to make sure the bullets are not upside down. The electrical adjustments and sensor feedback from the machine are operated and monitored through an HMI screen located on a box mounted to the side of the machine.

BRIEF DESCRIPTION WITH SEVERAL VIEWS OF DRAWINGS

DETAILED DESCRIPTION OF THE INVENTION

Figure 1A:
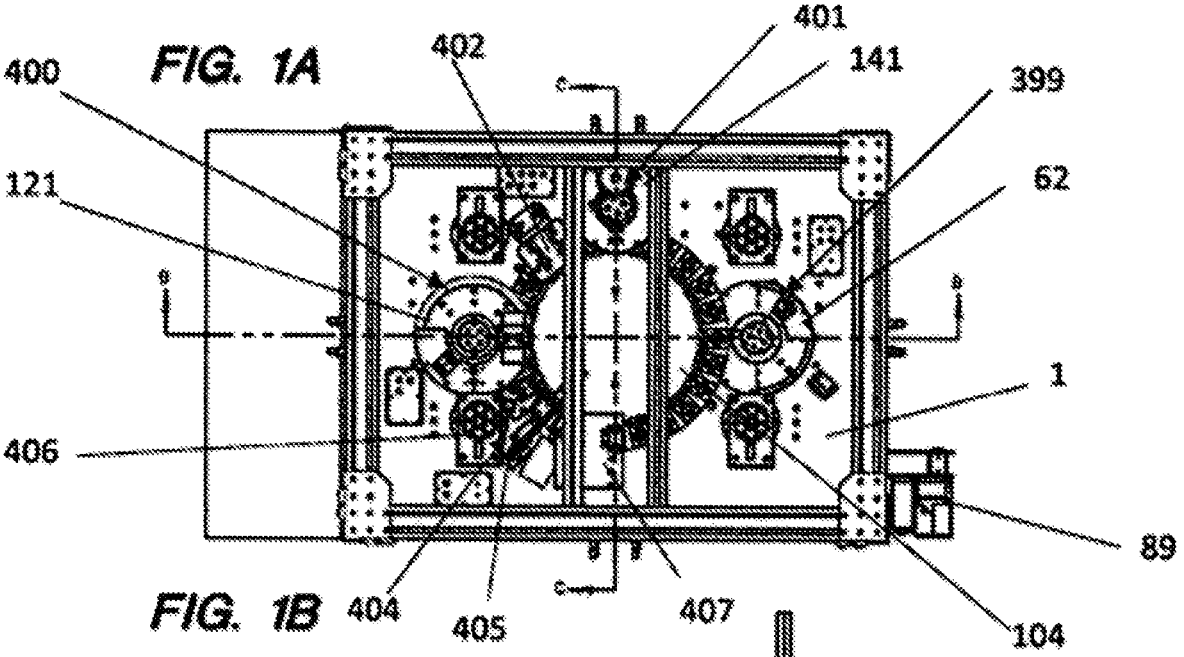
FIG. 1A is an elevated view of the machine without collators
Figure 1B:
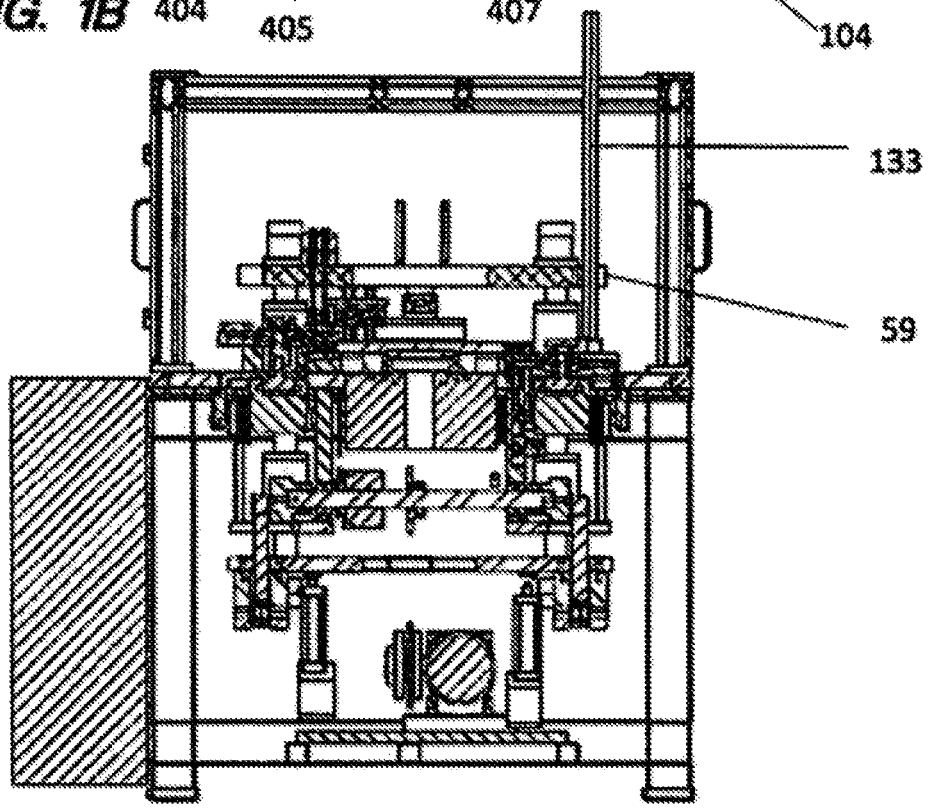
FIG. 1B is a front view of the machine without collators.
Figure 1C:
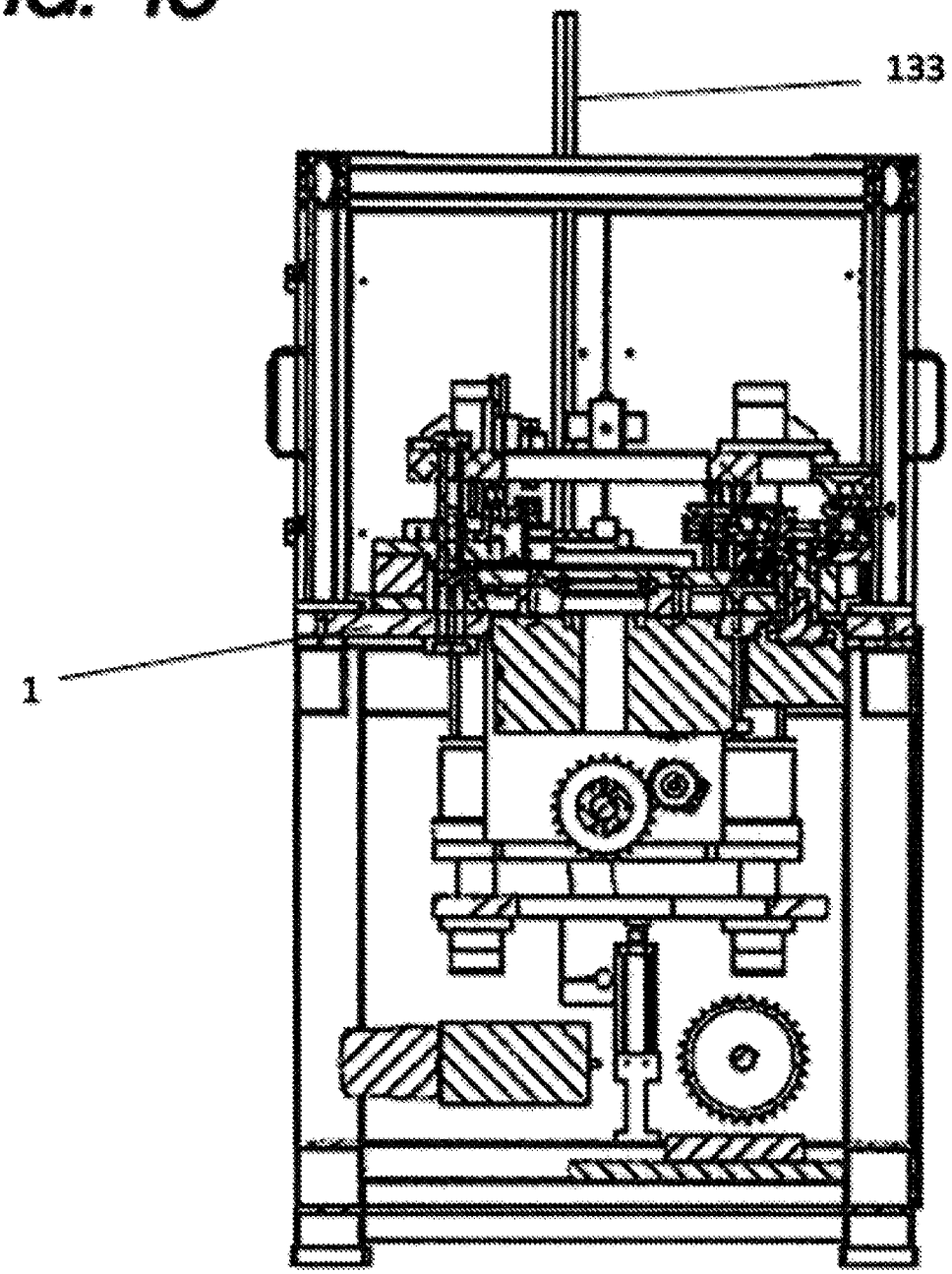
FIG. 1C is a left side view of the machine without collators.

With reference to the accompanying drawings, the Ammunition Production Loading Machine is further described in detail. As shown in FIGS. 1A-C the machine is comprised of a table-top 1, which provides a thick, rigid surface to mount the stations and hold the rotating and vertical components. A conveyor 89 moves completed cartridges to a discharge location when completed. A ram 59 supports the tooling for a bullet punch, crimp punch, debris check, eject and other additional options.

At the start of machine operation, at the case load station 399 cases 200 are fed into the case feed disk 62 from above, then rotated under the main disk 104 and pushed into the main disk 104 from below by a cam driven pin system. At the bullet load station 400 Bullets 201 are dropped into a bullet feed disk 121 from tubes above, then rotated over the main disk 104 and pushed into the cases 200 with pins mounted to the upper ram 59. At the powder load station, 401 Gun powder is dropped into measured openings in a powder disk 141 from a powder reservoir mounted above the powder disk 141. As the powder disk 141 rotates over the cases 200 in the main disk 104, the powder drops into the cases 200 in the main disk 104 and is measured for consistency at the powder laser station 402. The main disk 104 is the center disk and is further comprised of bullet crimp case bushings 300 which rotate from station to station in a counterclockwise direction.

The powder laser station 402 uses laser micrometers to verify the correct level of powder being delivered to each case 200. An inspection station 404 is comprised of a laser OAL 405 comprised of a set of laser micrometers that verify the overall height of each cartridge assembly. A crimp station 406 is comprised of formed-end, spring-loaded pins driven by the upper ram 102 that push on the crimp case bushings 300 in the main disk 104 that engage the internal crimp feature of the case bushing 300. An Eject/Reject station 407 will discard reject assemblies based on the inspection station 404 OAL laser 405 readings. The Eject/Reject station 407 will also eject the finished cartridges through the table-top 1 and onto the discharge conveyor 89.

Figure 2B:
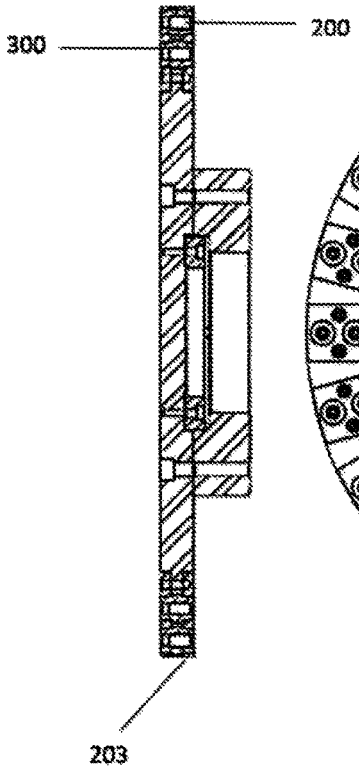
FIG. 2B is a midline sectional view of the main disk assembly of the machine.
Figure 2A:
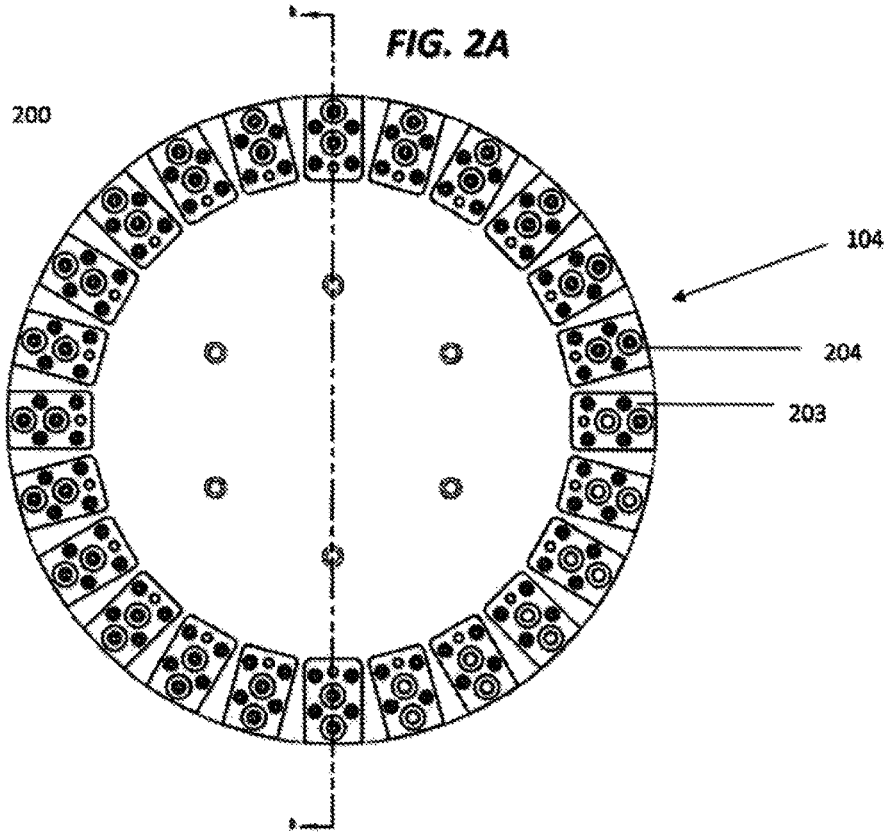
FIG. 2A is an elevated top view of the main disk assembly of the machine.
Figure 2C:
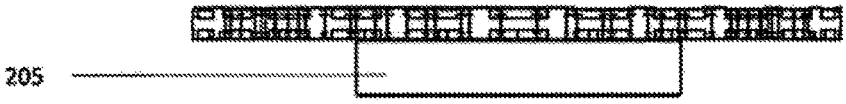
FIG. 2C is a side view of the main disk assembly of the machine.

FIGS. 2A-C provide further detail of the main disk 104 assembly of the machine. The main disk 104 assembly holds the cartridge assembly and moves the case 200 from station to station. The main disk is mounted to a central disk riser 205. The main disk is further comprised of a plurality of selectively removable case holder inserts 203 inserted into the perimeter of the main disk 104. Each case holder insert is comprised of at least one case holder 204 where said case holders 204 are sized to accept the specific dimensions of the cases 200 being reloaded. Each case holder 204 is further comprised of a bullet crimp case bushing 300 which crimps the bullet 201 to the case 200. In the preferred embodiment the case holder inserts 203 are selectively interchangeable to accommodate ammunitions of differing sizes.

Figure 3A:
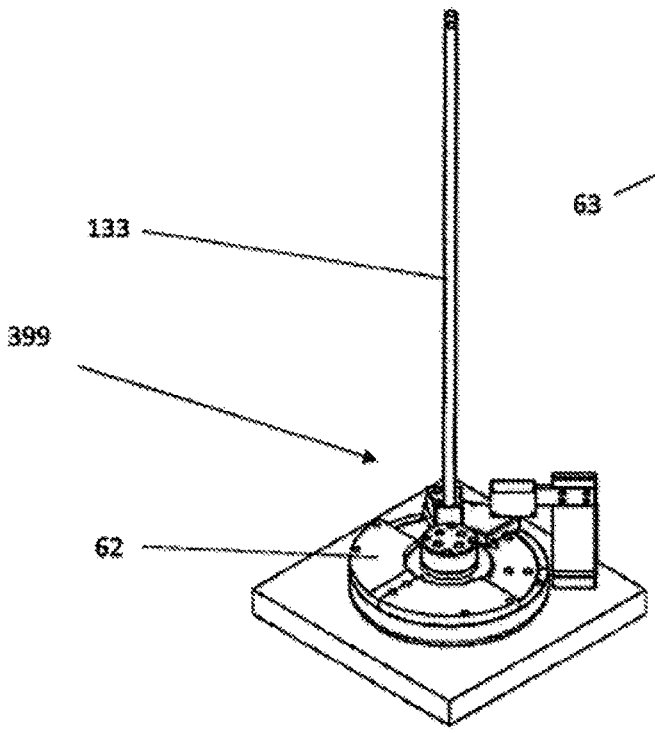
FIG. 3A is a perspective view of the case feed assembly of the machine.
Figure 3B:
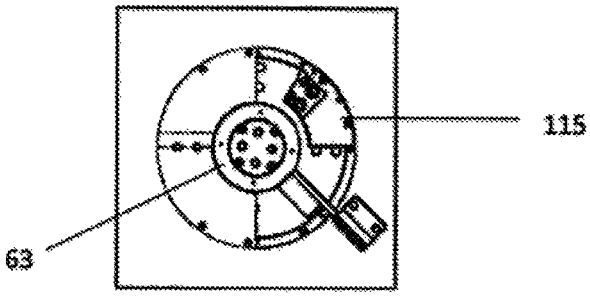
FIG. 3B is an elevated top view of the case feed assembly of the machine.
Figure 3C:
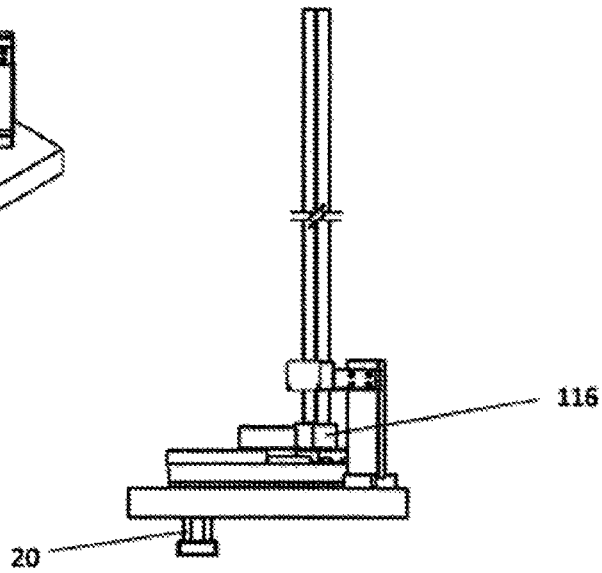
FIG. 3C is a side view of the case feed assembly of the machine.

FIGS. 3A-C provide further detail of the case feed assembly of the machine. The case feed disk 62, is the rotating disk that moves the cases 200 from the vertical case teed tubes 133 to the horizontal, rotating condition under the main disk 104. A clutch assembly 63, in case of a case jam or liming issue, protects the indexer 15 from being over torqued. A lid 115 is used to mount the case feed tube adapter 116 and keep the cases 200 in position vertically. A case adapter 116 locates the cases 200 over holes in the case feed disk 62 and locates case feed tubes 133 coming in from above. Case feed tubes 133 carry the cases 200 for the collator mounted above to the case feed adapter 116. Lift pins 20 are used to push the cases 200 into the main disk 104 from the case feed disk 62 from below.

Figure 4:
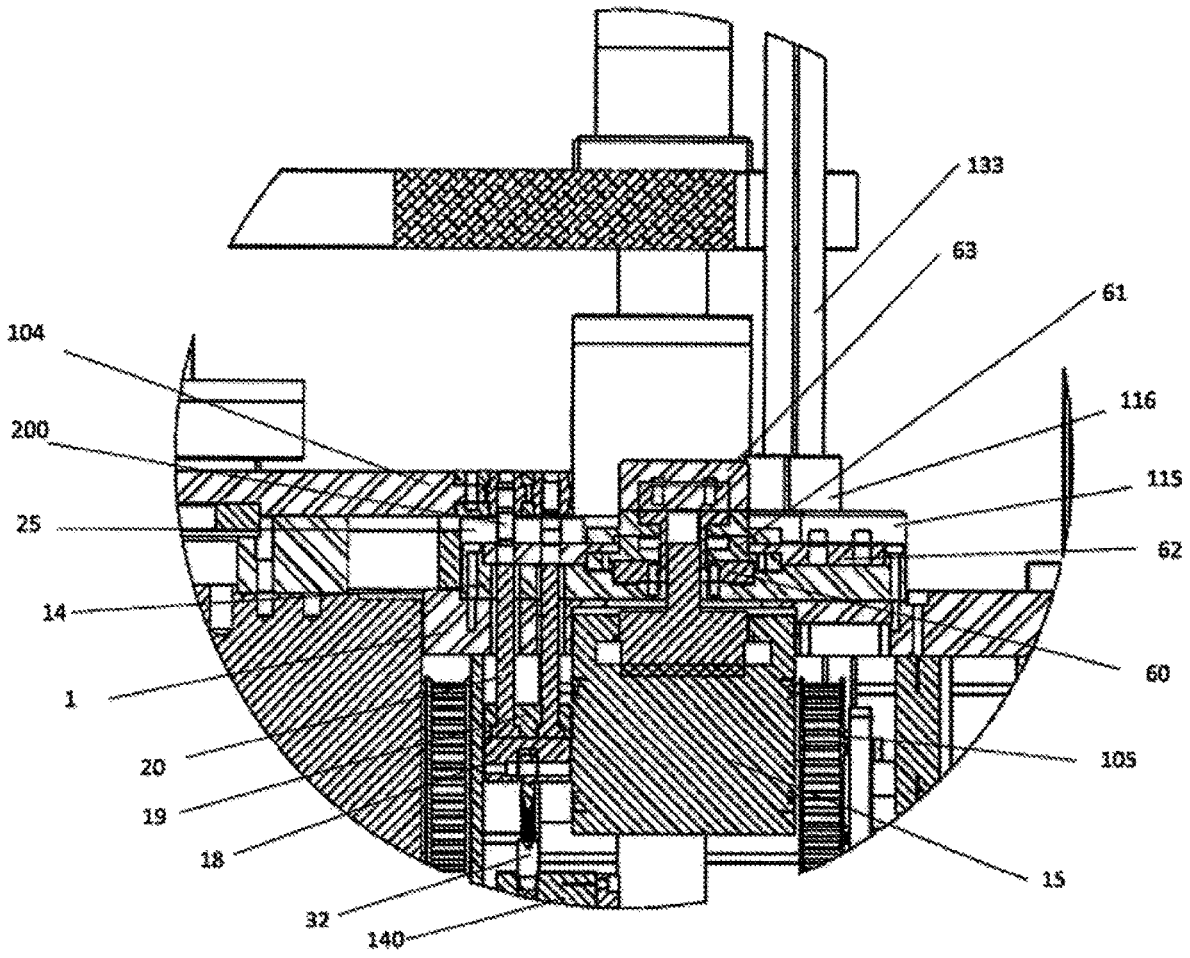
FIG. 4 is a magnified sectional view of the case feed station of the machine.

FIG. 4 provides further detail of the case load station 399 of the machine. The table-top 1 mounts an indexer 15, a disk carrier 14 and supports a push pins base 18 and pins 20. The disk carrier 14 locates the rotating disk assembly with bearings and centers it on the indexer 15 mounted below which rotates the disk in unison with the other rotating disks. The indexer 15 rotates the disk and pauses with a specific dwell time to allow the upper operations to take place. The push pins base 18 is mounted above and, it is actuated by an adjustable turnbuckle 32 and cam 140 from below. A pin cap 19 holds the pins 20 down to the base 18. Pins 20 are used to push the cases 200 into the main disk 104 from the case feed disk 62 from below. A cover 25 guides the cases 200 from the case feed disk 62 into the main disk 104. An adjustable turnbuckle 32 is between the crankshaft driven cam and the push pin assembly. A bearing 60 is mounted between the disk carrier and the case feed disk to allow rotation. A hub 61, is mounted to the bearing 60 and the disk and keeps the parts concentric. The case feed disk 62, is the rotating disk that moves the cases 200 from the vertical tubes to the horizontal, rotating condition under the main disk 104. A clutch assembly 63, in case of a case jam or timing issue, protects the indexer 15 from being over torqued. The main disk 104 assembly holds the cartridge assembly and moves the case 200 from station to station. Driver pulleys 105 turn the input shaft on the indexer 15 and are driven by a crank shaft. A lid 115 is used to mount the case feed tube adapter and keep the cases 200 in position vertically. A case adapter 116 locates the cases 200 over holes in the case feed disk 62 and locates case feed tubes 133 coming in from above. Case feed tubes 133 carry the cases 200 for the collator mounted above to the case feed adapter 116. The block 140 mounts to the cam on the end of the crankshaft and turns the rotating motion into vertical movement.

Figure 5A:
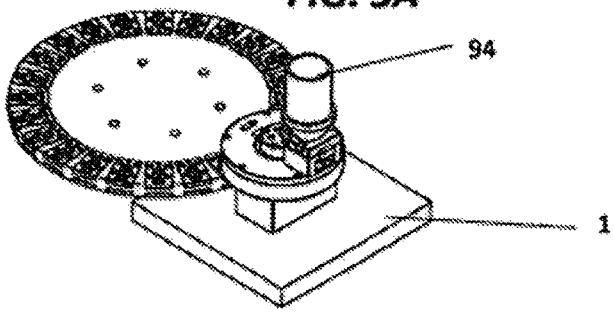
FIG. 5A is a perspective view of the powder feed assembly of the machine.
Figure 5B:
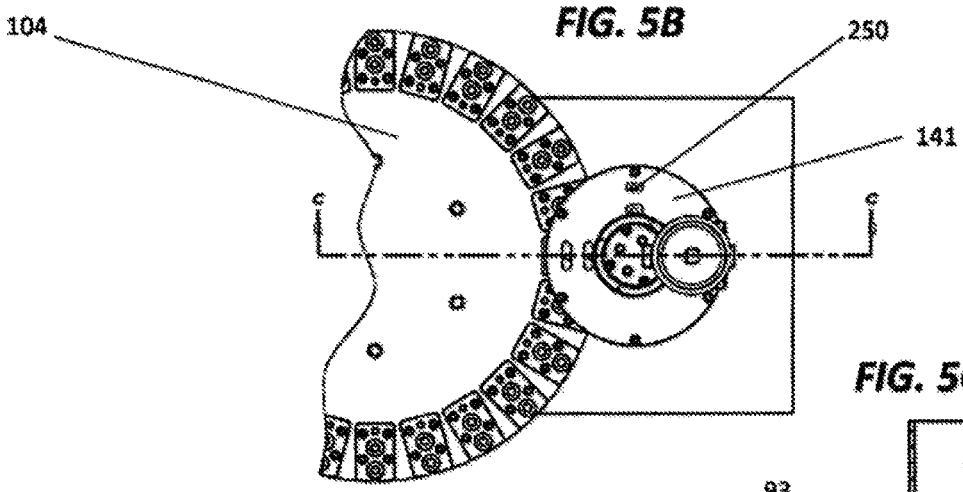
FIG. 5B is an elevated top view of the powder feed assembly of the machine.
Figure 5C:
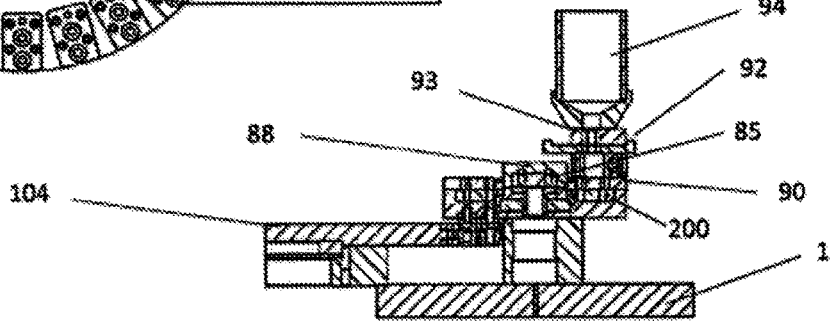
FIG. 5C is a sectional view of the powder feed assembly of the machine.

FIGS. 5A-C show the powder feed assembly of the machine. The table-top 1 provides a thick mount for the indexer 15 and the powder base 2. The powder base 2 is used to mount the rotating powder disk assembly and provide a mount for the powder reservoir 94. The indexer 15 rotates the powder disk 141 and pauses with a specific dwell time to allow the upper operations to take place. The powder disk 141 has a series of calibrated holes 250 to allow a set quantity of gun powder by volume to enter. The powder disk 141 then rotates over the main disk 104 and allows the gun powder to fill the empty cases 200. A hub 85 mounts between the clutch 88 and the powder disk 141. The clutch 88, in case of a case jam or timing issue, protects the indexer 15 from being over torqued. A cap 90 arranges the powder to meet the holes 250 in the powder disk 141. A knife gate 92 provides a mechanical means to shut off feed gun powder to the powder disk. An adapter 93 moves the powder from the reservoir 94 to the powder disk assembly. The reservoir 94 holds the powder until need by the powder disk 141. The reservoir 94 is filled periodically from a larger reservoir mounted above the machine assembly.

Figure 6:
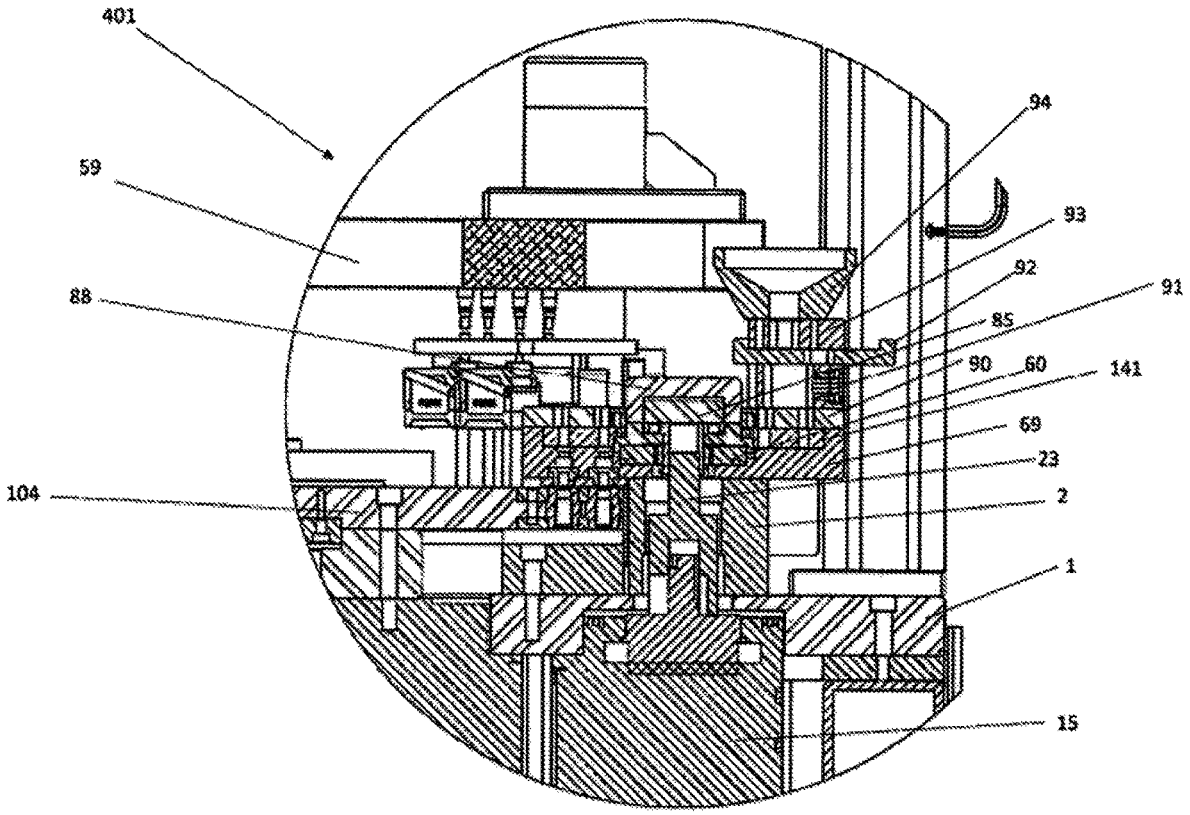
FIG. 6 is a magnified sectional view of the powder feed station of the machine.
Figure 7A:
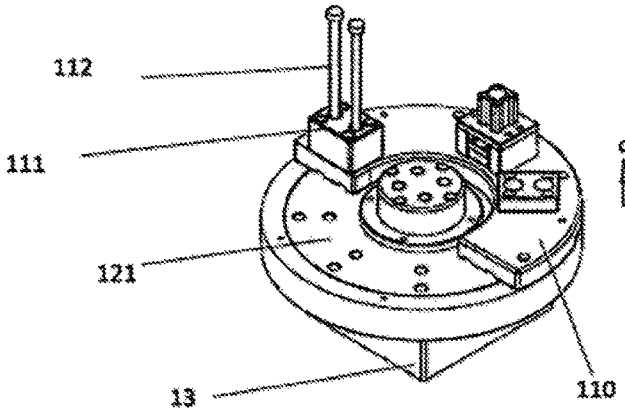
FIG. 7A is a perspective view of the bullet feed assembly of the machine.
Figure 7B:
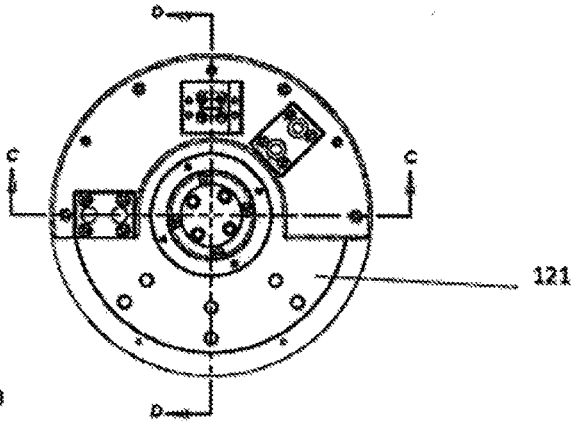
FIG. 7B is an elevated top view of the bullet feed assembly of the machine.
Figure 7C:
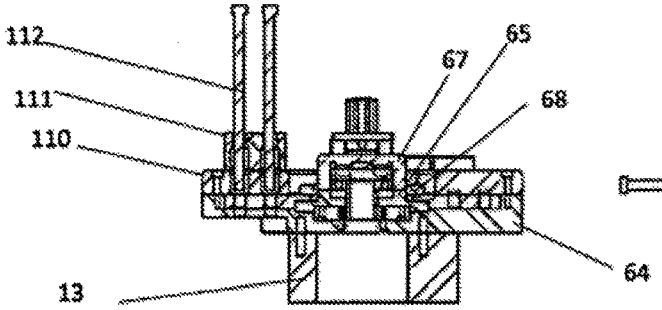
FIG. 7C is a sectional view of the bullet feed assembly of the machine.
Figure 7D:
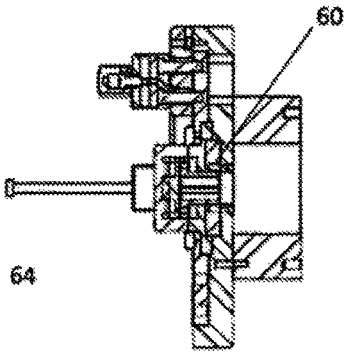
FIG. 7D is a sectional view of the bullet feed assembly of the machine.

FIG. 6 provides further detail of the powder load station 401 of the machine. The table-top 1 provides a thick mount for the indexer 15 and the powder base 2. The powder base 2 is used to mount the rotating powder disk assembly and provide a mount for the powder reservoir 94. The indexer 15 rotates the powder disk 141 and pauses with a specific dwell time to allow the upper operations to take place. A shaft extension 23 goes between the indexer and the rotating powder disk 141. An upper ram 59 assembly is comprised of tooling and pins for the other stations. The bearing 60 is located between the disk carrier 69 and a clutch 88. The disk carrier 69 locates the rotating disk assembly in relation to the main disk 104. The powder disk 141 has a series of calibrated holes to allow a set quantity of gun powder by volume to enter. The powder disk 141 then rotates over the main disk 104 and allows the gun powder to till the empty cases 200. A hub 85 mounts between the clutch 88 and the powder disk 141. The clutch 88, in case of a case jam or timing issue, protects the indexer 15 from being over torqued. A cap 90 arranges the powder to meet the holes in the powder disk 141. A riser 91 allows a blow off location in case of powder ignition event. A knife gate 92 provides a mechanical means to shut off feed gun powder to the powder disk. An adapter 93 moves the powder from the reservoir 94 to the powder delivery disk assembly. The reservoir 94 holds the powder until need by the powder disk 141. The reservoir 94 is filled periodically from a larger reservoir mounted above the machine assembly.

FIGS. 7A-D show the bullet feed assembly of the machine. A lid 110 holds bullets 201 in position as they ore rotated around in the bullet feed disk 121 and also locales bullet punch pins 112 with bushings. A punch guide 111 locates the punch pins 112 with bushings and is mounted to the lid 110. The bullet punch pins 112 are lowered through the punch guide 111 and lid 110 by the upper ram 59. When the bullets 201 rotate over the cases 200 in the main disk 104 the upper ram 59 lowers to drive the bullets 201 into the cases 200. A detent piston 113 is used to set the push distance of the bullet punch pins 112 and adjusts the overall height of the complete assembled cartridge. A bullet riser 13 is used to mount the bullet feed assembly to the table-top 1. It is also used to make final height adjustments between the two disk assemblies. The indexer 15 rotates the bullet feed disk 121 and pauses with a specific dwell time to allow the upper operations to take place. A detent block 37 holds the upper bullet punch pins 112 to the upper ram 59. The bearing 60 mounts to the plate carrier 64 and the clutch assembly 67. The plate carrier 64 locates and mounts the rotating bullet feed disk 121 assembly above the main disk 104. The hub 65 mounts the rotating bullet feed disk 121 to the clutch assembly 67. The bullet feed disk 121 transfers the bullets 201 vertically from the feed tubes to the rotating main disk 104. The clutch assembly 67, in the event of a case jam or timing issue, protects the indexer 15 from being over torqued. A clamp plate 68 holds the rotating bullet feed disk 121 to the hub 65, when loosened the clamp plate 68 allows the bullet feed disk 121 to be rotated in relation to the hub 65 to position the holes of the bullet feed disk 121 in the correct location over the main disk 104.

Figure 8:
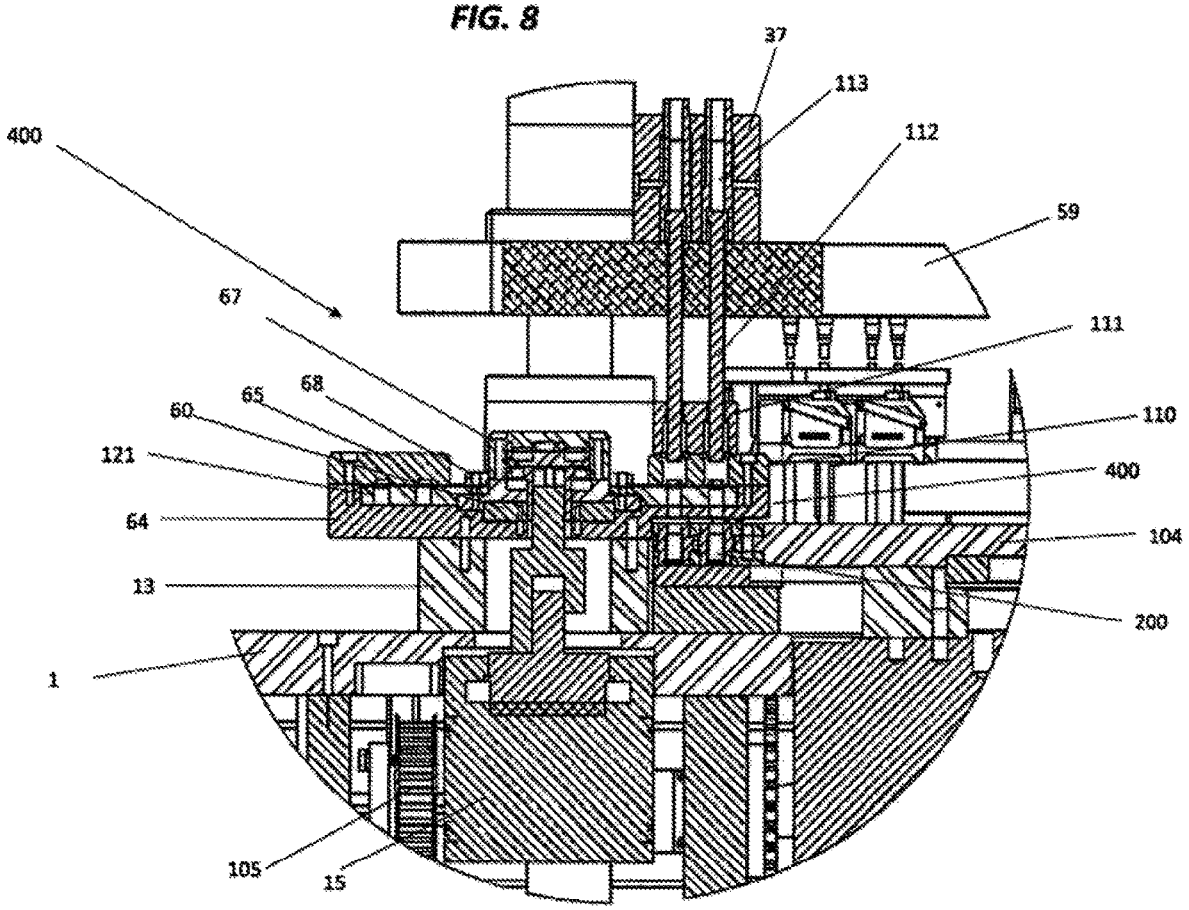
FIG. 8 is a magnified sectional view of the bullet feed station of the machine.

FIG. 8 provides further detail of the bullet load station 400 of the machine. The main disk 104 assembly holds the cartridge assembly and moves the case 200 from station to station. Driver pulleys 105 turn the input shaft on the indexer 15 and are driven by a crank shaft. A lid 110 holds bullets 201 in position as they are rotated around in the bullet feed disk 121 and also locates bullet punch pins 112 with bushings. A punch guide 111 locates the punch pins 112 with bushings and is mounted to the lid 110. The bullet punch pins 112 are lowered through the punch guide 111 and lid 110 by the upper ram 59. When the bullets 201 rotate over the cases 200 in the main disk 104 the upper ram 59 lowers to drive the bullets 201 into the cases 200. A detent piston 113 is used to set the push distance of the bullet punch pins 112 and adjusts the overall height of the complete assembled cartridge. A bullet riser 13 is used to mount the bullet feed assembly to the table-top 1. It is also used to make final height adjustments between the two disk assemblies. The indexer 15 rotates the bullet feed disk 121 and pauses with a specific dwell time to allow the upper operations to take place. A detent block 37 holds the upper bullet punch pins 112 to the upper ram 59. The bearing 60 mounts to the plate carrier 64 and the clutch assembly 67. The plate carrier 64 locates and mounts the rotating bullet feed disk 121 assembly above the main disk 104. The hub 65 mounts the rotating bullet feed disk 121 to the clutch assembly 67. The bullet feed disk 121 transfers the bullets 201 vertically from the feed tubes to the rotating main disk 104. The clutch assembly 67, in the event of a case jam or timing issue, protects the indexer 15 from being over torqued. A clamp plate 68 holds the rotating bullet feed disk 121 to the hub 65, when loosened the clamp plate 68 allows the bullet feed disk 121 to be rotated in relation to the hub 65 to position the holes of the bullet feed disk 121 in the correct location over the main disk 104. The bullet load station is further comprised of a powder laser assembly 400. The powder laser assembly 400 uses laser micrometers to verify the correct level of powder being delivered to each case 200. The main disk 104 assembly holds the cartridge assembly and moves the case 200 from station to station.

Figure 9:
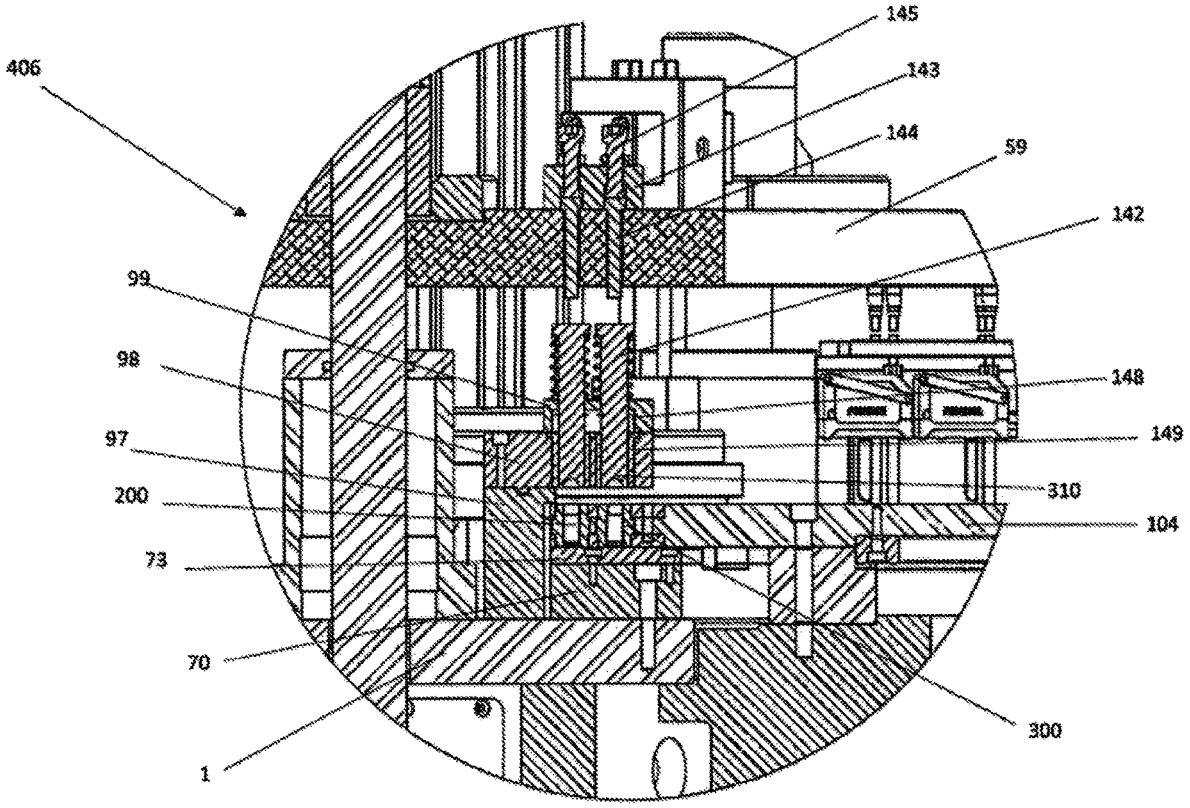
FIG. 9 is a magnified sectional view of the crimping station of the machine.

FIG. 9 provides further detail of the case bullet crimp station 406 of the machine. The table-top 1, provides a thick mount for the support ring 70, which mounts the crimping assembly. The support ring 70 mounts the wear plate 73 to the table-top 1. The wear plate 73 is a disk, which the bottom of the cases 200 ride against and also provides a stable base for the bullet crimp case bushings 300 in the main disk 104 to be acted upon by spring-loaded push pins 142. A crimp base 97 mounts to the table-top 1 and locates the spring-loaded upper pin assembly. A plate 98 is comprised of bushings to guide the spring-loaded push pins 142. A pin block 99 provides a stop for external retaining rings 148 so the spring-loaded push pins 142 do not over-extend beyond their mounting plate 98. The main disk assembly 104, holds the cartridge assembly and moves the case 200 from station to station. The spring-loaded push pins 142 push down on the bullet crimp case bushings 300 in the main disk 104. When the bullet crimp case bushings 300 are pushed down, the internal crimp feature 500 will close the cases 200 to the bullets 201 completing the assembly. The spring-loaded push pins 142 have a relief 310 on the ends to clear the tops of the bullets 201. A pin cap 143 mounted to the upper ram 59 guides upper push pins 144 to make contact with the lower spring-loaded push pins 142. The upper push pins 144 are adjustable with bolts 145 mounted above. The adjustment allows more or less crimp force to be applied to the bullet crimp case bushings 300. The upper push pins 144 actuate the lower spring-loaded pins 142. Springs 147 are used to return the lower push pins 142 to starting position. The external retaining rings 148 limit the travel of the lower spring-loaded push pins 142. Bushings 149 keep the lower spring-loaded push pins 142 located properly.

Figure 10A:
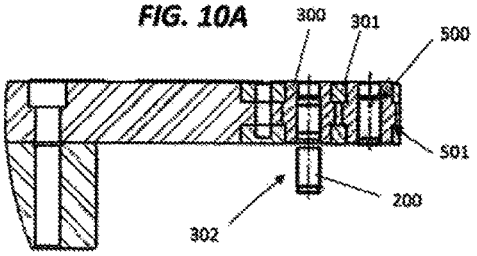
FIG. 10A is a sectional view of the bullet crimp case bushing of the disk assembly of the machine showing case insertion into bushing from below.
Figure 10B:
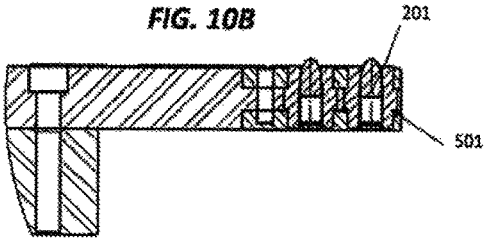
FIG. 10B is a sectional view of the bullet crimp case bushing of the disk assembly of the machine showing powder and bullets into cases.
Figure 10C:
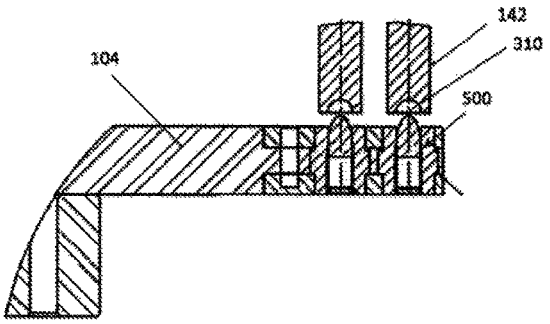
FIG. 10C is a sectional view of the bullet crimp case bushing of the disk assembly of the machine showing bushing being pressed down by upper ram posts to crimp cases to bullet.

FIGS. 10A-C provide further detail of the bullet crimp case bushings 300 of the main disk 104 of the machine. The bullet crimp case bushings 300 floats in a bushing retainer 301 that allows vertical movement of the bushing within the assembly when the cases 200 are loaded from below 302. The cases 201 are loaded from below by a cam driven lift pin 20 that lifts the cases 200 through the case feed disk 62 and into the bullet crimp case bushings 300 of the main disk 104. As the case 200 moves into the bullet crimp case bushing 300 the case 200 lifts the bullet crimp case bushing 300 in the retainer disk assembly 301 by pushing the case 200 up against the tapered crimp feature 500 inside the bullet crimp case bushing 300. This creates an air gap 501 between the bottom of the bullet crimp case bushing 300 and the hushing retainer 301.

Spring-loaded push pins 142 push down on the bullet crimp case bushings 300 in the main disk 104. The spring-loaded push pins 142 have a relief 310 on the ends to clear the tops of the bullets 201 so the downward force is applied to the bullet crimp case bushing 300 while the wear plate 73 provides a stable base for the bottom of the case and bullet crimp case bushing 300. When the bullet crimp case bushings 300 are pushed down, the air gap 501 between the bottom of the bullet crimp case bushing 300 and the bushing retainer 301 is closed and the tapered the internal crimp feature 500 crimps the cases 200 to the bullets 201 completing the assembly.

Figure 11:
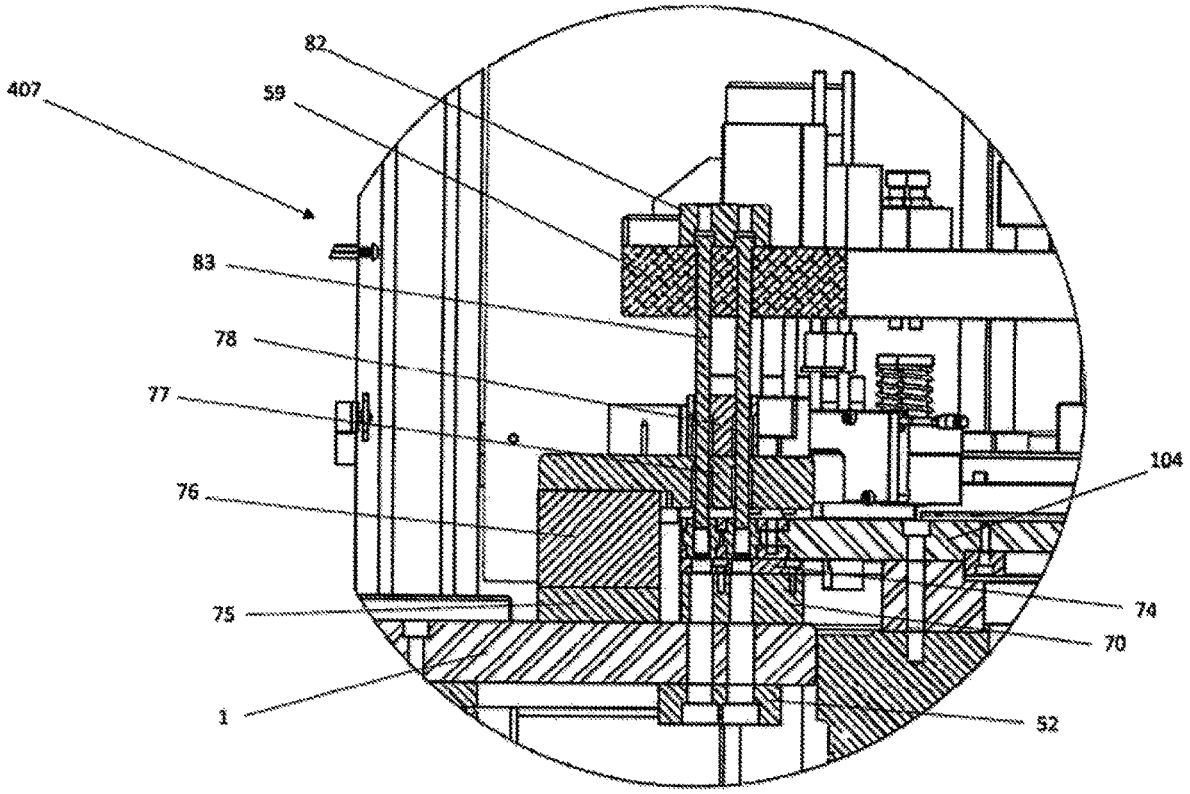
FIG. 11 is a magnified sectional view of the eject station of the machine.

FIG. 11 provides further detail of the eject/reject station 407 of the machine. The table-top 1, provides a thick mount for the support ring 70, which mounts the crimping assembly. An eject receiver 52 guides the completed cartridge assemblies to the conveyor 89. The upper ram 59 assembly contains tooling and pins for the stations. The upper ram 59 also provides vertical movement to actuate pins. The support ring 70 is used to mount the wear plate 74 to the table-top 1. The wear plate 74 provides a surface for the main disk 104 to ride on and counteracts the force of the eject push pins 83 which force the finished cartridges out of the main disk 104. A base plate 75 provides a solid mount surface for the upper structure of the eject assembly and is mounted to the table-top 1. An upright 76 locates a top plate 77. The top plate 77 uses bushings to guide the eject push pins 83 which push the completed cartridge assembly out of the main disk 104. A guide block 78 guides the eject push pins 83 into the top plate 77 from fully up to the lowest position. A pin cap 82 retains the eject push pins 83 in the upper ram 59. The eject push pins 83 are used to remove the complete assembled cartridge from the main disk 104 by pushing down and through the main disk 104 into the eject holes of the table-top 1.

It is understood that the foregoing examples are merely illustrative of the present invention. Certain modifications of the articles and/or methods may be made and still achieve the objectives of the invention. Such modifications are contemplated as within the scope of the claimed invention.

What is claimed is:

1. A fully automated ammunition production loading machine comprising:

A. A Case Load Station comprised of a case collator, a case feed assembly, a case feed disk, and a lower mechanical case pusher to insert cases into a main disk;

B. A Powder Load Station comprised of a powder hopper, one or more powder slides, one or more powder delivery tubes, a powder feed disk, and a laser powder measuring check;

C. A Bullet Load Station comprised of one or more bullet collators, a bullet feed assembly, a bullet disk;

D. A Case Bullet Crimp Station comprised of an upper crimp tool driven by an upper ram, one or more bullet crimp case bushings of said main disk;

E. An Inspection Station comprised of an overall length laser height check;

F. A Reject Station, wherein an assembled case is removed from said main disk in the event of a perceived tolerance violation identified by said Inspection Station;

G. An Eject Station comprised of a mechanical assist to remove an assembled cartridge from said main disk bullet crimp case bushing and drop onto an internal conveyor;

Wherein said main disk, case feed disk, powder feed disk and bullet feed disk are rotated by a cogged belt drive.

2. The fully automated ammunition production loading machine of claim 1, further comprising a sensor mounted on said Case Load Station to detect upside down or damaged cases.

3. The fully automated ammunition production loading machine of claim 1, further comprising one or more spring-loaded push pins, which push down on said one or more bullet crimp case bushings.

4. The fully automated ammunition production loading machine of claim 3, wherein said one or more bullet crimp case bushings are further comprised of an internal tapered crimp feature.

5. The fully automated ammunition production loading machine of claim 4, wherein said one or more bullet crimp case bushings float in one or more bushing retainers, which allow vertical movement of said one or more bullet crimp case bushings when said cases are loaded from below.

6. The fully automated ammunition production loading machine of claim 5, wherein said case is pushed up against said internal tapered crimp feature of said bullet crimp case bushing, which creates an air gap between the bottom of said bullet crimp case bushing and said bushing retainer.

7. The fully automated ammunition production loading machine of claim 6, wherein said spring-loaded push pins push down on said bullet crimp case bushings, which causes said tapered internal crimp feature to crimp said case to a bullet.

8. The fully automated ammunition production loading machine of claim 1, wherein said main disk is further comprised of one or more of a removable case holder insert.

9. The fully automated ammunition production loading machine of claim 8, wherein said removable case holder insert is sized to accept a specific dimension of a case to be reloaded.

10. The fully automated ammunition production loading machine of claim 9, wherein said removable case holder insert is further comprised of said one or more bullet crimp case bushings.

11. The fully automated ammunition production loading machine of claim 10, wherein said bullet crimp case bushings are sized to accept a specific dimension of a case to be reloaded.

12. The fully automated ammunition production loading machine of claim 8, wherein said removable case holder insert is interchangeable to accommodate reloading of ammunitions of differing sizes.

* * * * *